US005165605A

United States Patent [19]

Morita et al.

[11] Patent Number: 5,165,605

[45] Date of Patent: Nov. 24, 1992

[54] LOW PRESSURE AIR ATOMIZING SPRAY GUN

[75] Inventors: Nobuyoshi Morita; Hajime Iwata; Satoru Murata; Masato Suzuki, all of Yokohama, Japan

[73] Assignee: Iwata Air Compressor Mfg. Co., Ltd., Tokyo, Japan

[21] Appl. No.: 502,281

[22] Filed: Mar. 30, 1990

[30] Foreign Application Priority Data

| | | | |
|---|---|---|---|
| Mar. 30, 1989 | [JP] | Japan | 1-79337 |
| Jul. 26, 1989 | [JP] | Japan | 1-87804 |
| Jul. 26, 1989 | [JP] | Japan | 1-87805 |
| Jul. 26, 1989 | [JP] | Japan | 1-193626 |

[51] Int. Cl.[5] ..... B05B 7/08

[52] U.S. Cl. ..... 239/296; 239/297; 239/599

[58] Field of Search ..... 239/296, 297, 299, 290, 239/599

[56] References Cited

U.S. PATENT DOCUMENTS

| | | | |
|---|---|---|---|
| 2,004,033 | 6/1935 | Buzzard et al. | 239/296 |
| 2,569,251 | 9/1951 | Nieburg | 239/297 |
| 4,386,739 | 6/1983 | Kwok | 239/296 |
| 4,657,184 | 4/1987 | Weinstein | 239/296 |
| 4,842,203 | 6/1989 | Kuhn et al. | 239/296 |
| 4,854,504 | 8/1989 | Hedger et al. | 239/296 |

FOREIGN PATENT DOCUMENTS

| | | | |
|---|---|---|---|
| 582605 | 7/1944 | United Kingdom | 239/296 |

*Primary Examiner*—Andres Kashnikow
*Assistant Examiner*—Kevin Weldon
*Attorney, Agent, or Firm*—Wenderoth, Lind & Ponack

[57] ABSTRACT

A low pressure atomizing spray gun is disclosed in which paint is injected from a nozzle, an opening of the nozzle is controlled by a needle valve, air is mixed with a flow of paint, air is blown from both sides after the air-paint mixture is sprayed from a spraying nozzle and it is again mixed and atomized. The nozzle is formed as circular hole with a circular outer shape, and the spray hole is designed with a lip-like shape having different dimensions in longitudinal and lateral directions and with a conical or similar shape. Lateral air holes are furnished in front of the spray hole, at opposite positions on both sides of the spray flow and function to blow the diffusing air flow toward the spray flow. A pair of longitudinal air holes is furnished to inject the secondary air obliquely from behind the spray hole and to make the air collide with the flattened spray pattern.

6 Claims, 6 Drawing Sheets

LOW PRESSURE AIR ATOMIZING SPRAY GUN

BACKGROUND OF THE INVENTION

The present invention relates to a spray gun which utilizes compressed air for atomizing and spraying materials such as paint, and more particularly to a spray gun which can sufficiently atomize the material when the pressure of compressed air is 1 kgf/cm$^2$ or less and which can avoid the splashing of paint particles and prevent environmental pollution.

A spray gun, generally called an air spray gun, is used in the painting and coating processes of spraying paint materials. Air spray guns which utilize compressed air for atomization are generally categorized as either internal mixing types or external mixing types.

The internal mixing type spray gun is one by which the material paint and the compressed air are mixed together within an atomizing head of the spray gun, and an air-liquid mixture is injected and atomized from the atomizing nozzle. In the external mixing type spray gun, a paint dispensing hole and an air dispensing hole open outwardly from the atomizing head, and the liquid paint flow dispensed through the paint dispensing hole is dispersed and atomized by the air flow, which is diffused and blown around the paint flow.

These spray guns utilize the suction force of the compressed air for the spraying of the paint or the paint is sprayed by a force-feed unit such as a pump at a pressure of several kgf/cm$^2$, and atomization is not achievable by merely spraying the paint material. The air is used as a force for atomizing the paint, and a pressure of 2–5 kgf/cm$^2$ is usually applied.

For example, in a conventional internal mixing type spray gun 100, as shown in FIG. 11, a paint nozzle 101 opens into an air cap 102. The nozzle hole 104 is opened and closed by a needle valve 103 to control the flow of the paint. Compressed air is supplied from around the nozzle hole 104 in order to disperse the paint within the air cap 102, and the paint is sprayed out from the spray hole 105, which is located in opposing relation to the nozzle hole 104 and opens into the center of the air cap 102.

Such conventional internal mixing type spray gun is generally used as a special spray gun to spray wall paint or adhesive in cases where strict smoothness of the painted surface is not required, because the size of the sprayed particles is coarser than that produced by external mixing type guns.

In contrast, external mixing type guns are generally used as so-called spray guns and are known as being suitable for various types of paint materials and various painting conditions. The common features of this type spray gun are that the nozzle hole of the paint nozzle is located at the center, and the nozzle hole faces to the outside of the atomizing head. An annular air hole is provided around the nozzle hole, and compressed air is blown at a pressure of 3–5 kgf/cm$^2$ as it surrounds the paint flow from the nozzle hole. Namely, the paint and the compressed air are dispensed separately and are mixed and atomized in front of and outside the atomizing head. Usually, most of the spray guns of this type are designed in such a manner that lateral air holes are provided on both sides, and compressed air is sprayed from both sides to said spray flow in order to adjust the shape of the spray pattern. Therefore, a spray flow sprayed in a circular pattern at the center may be flattened by changing the air flow pressure and quantity from the lateral air holes. In the case of this spray gun, better atomization is achieved when compressed air quantity (or pressure) is increased, such that the painted surface is provided with a good finish due to the spraying of finer particles. However, the paint is splashed more in this case.

In conventional type spray guns as described above, there is the problem with the splashing of paint because it is atomized by air, and unfavorable results occur in terms of paint adhesion efficiency and environmental hygiene. Above all, this trend becomes more conspicuous when air spray pressure is increased, thus it is desirable to spray at lower pressure. On the other hand, it is important to have finer atomized particles for better finishing of the painted surface. For this purpose, it is necessary to atomize the paint with high pressure air, and this is contradictory to the elimination of paint splashing. At present, the spraying is performed by accepting the problem of splashing, and sacrificing paint adhesion efficiency and environmental hygiene.

However, importance will be increasingly placed in the future on the effective utilization of the material resources and maintenance of the environment, and spray guns which can atomize material at low pressures are in demand. The means to atomize the paint material is not necessarily limited to compressed air, and a method is generally practiced, in which paint material is dispensed at high pressure from the nozzle and is atomized through its collision with atmospheric air. However, spray guns for industrial purposes require high pressures of 100 kgf/cm$^2$, and are also dangerous because a special type pump is used. For this reason, spray guns are used in which paint material pressure is decreased to several tens of kgf/cm$^2$ and in which compressed air is simultaneously dispensed. But, the above problems remain because air pressures for spray guns are not sufficiently low, and satisfactory spray guns are not yet available.

SUMMARY OF THE INVENTION

To solve the above problems, the object of this invention is to offer a spray gun, in which the spraying air pressure is decreased as low as 1 kgf/cm$^2$ or less and which can atomize the spray particles to the same degree as conventional type spray guns in order to provide a better finish for the sprayed surface.

To attain this object, the present invention comprises a spray gun, characterized in that the paint is dispensed from the nozzle, that the opening of the nozzle is controlled by a needle valve, that air is mixed with the dispensed paint flow, that air is blown from both sides toward the air-paint mixture sprayed from the spraying nozzle such that it is again mixed and atomized. The nozzle is formed with a cylindrical hole having a circular outer shape, and the spray hole is designed in a lip-like shape having different dimensions in longitudinal and lateral directions and having a conical or similar outer shape. Also, lateral air holes are furnished in front of the spray hole, at opposite positions on both sides of the axis of the spray pattern and function to blow the diffusing air flow forwardly and toward the spray axis.

A pair of second dispensing holes is furnished to inject the secondary air from obliquely behind the nozzle hole and to make the air collide with the flattened spray flow.

By the above arrangement of this invention, the paint sprayed from the nozzle is mixed and dispersed by the compressed air supplied from around it and is sent toward the spray hole. Because the spray hole has different opening dimensions in longitudinal and lateral directions, the paint-air mixture is sprayed in a flattened elliptical shape. Then, compressed air is blown toward this spray flow from the air holes on both sides of the spray hole, the spray particles are enveloped by the air, and the pattern is stabilized. The coarse particles are atomized, and particle size is equalized. Because the first atomization is performed within the cap, the material is atomized at low pressure and with less air quantity. Also, because the air supplied from the air holes on both sides is blown toward the spray flow in a flattened pattern from the direction of the shorter axis of the pattern, the width of the pattern can be efficiently increased and the particle size can be reduced with the air flow at low pressure.

The secondary air blown from the secondary holes obliquely behind said spray hole function to reduce the size of the pattern, and a circular pattern with less spreading can be obtained.

BRIEF DESCRIPTION OF THE DRAWINGS

The advantages and features of the present invention will be more easily understood in connection with the drawings, in which.

DESCRIPTION OF THE PREFERRED EMBODIMENT

The arrangement and the effects of the present invention will be more easily understood by the following description.

Figure 1:
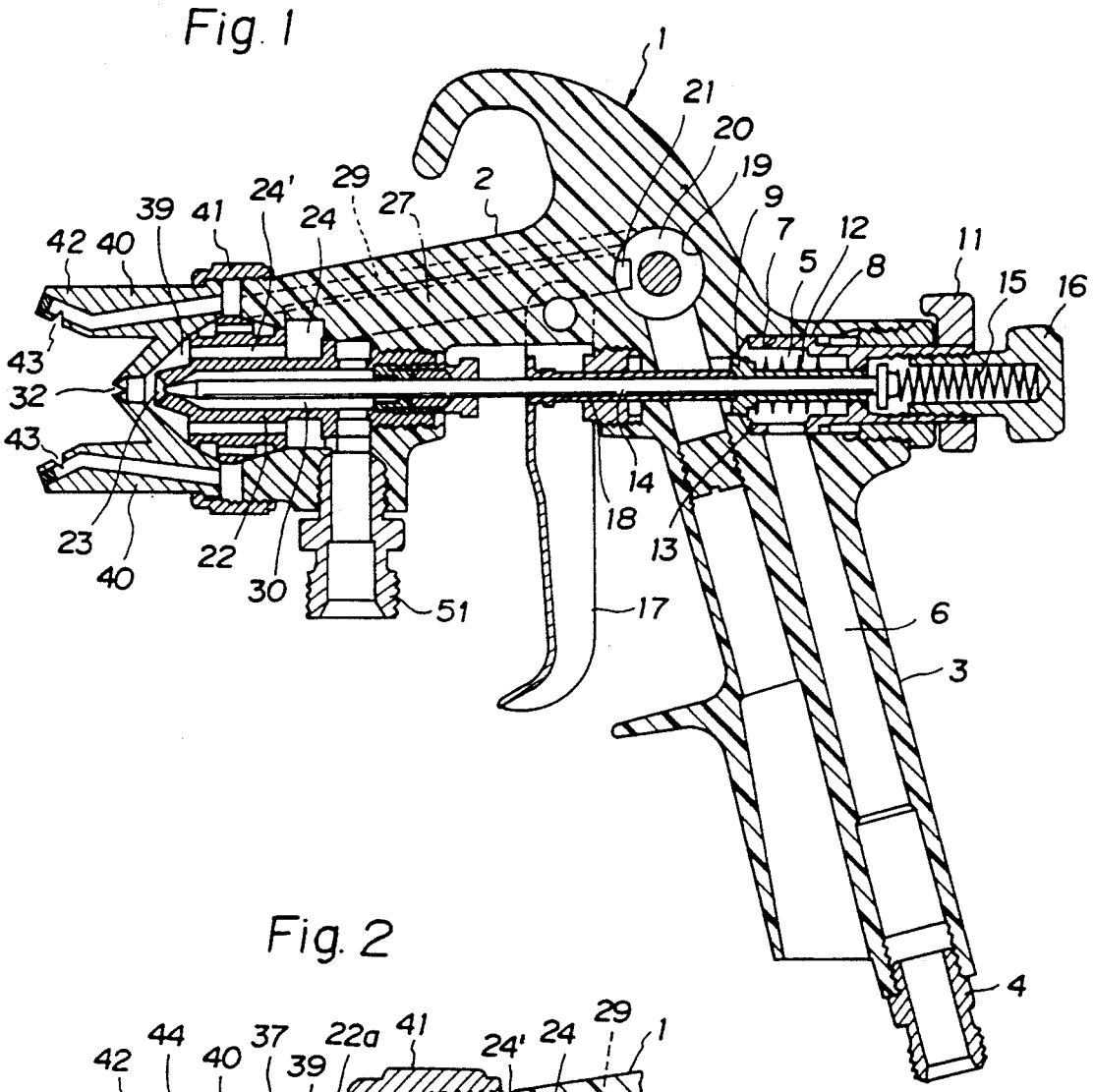
FIG. 1 is a cross-sectional view showing the basic configuration of this invention.
Figure 2:
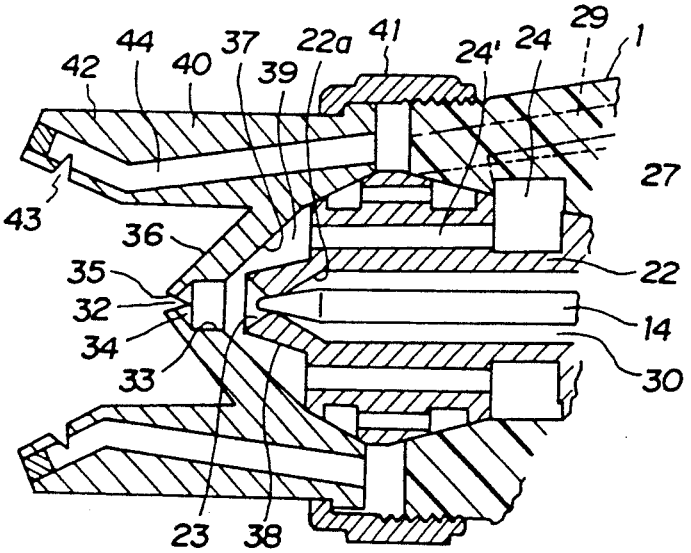
FIG. 2 is an enlarged cross-sectional view of an essential part of an atomizing head.

FIG. 1 shows a general arrangement of a spray gun according to the present invention.

The spray gun main unit 1 consists of a gun barrel 2 and a grip 3. Below the grip 3, an air nipple 4 is furnished to receive externally supplied compressed air, and is connected by an air hose with an air source (not shown). Inside the grip 3, a passage hole 6 is furnished to supply the compressed air into an air valve unit 5, and said air valve unit 5 comprises an air valve 9 inside an air regulation pipe 8, which is inserted into an air regulation hole 7 formed in the gun barrel 2 from the rear end thereof. The air regulation pipe 9 is provided with a hole 10, passing from outside to inside. By turning the air regulation pipe 8, air flow is changed according to the alignment of the hole 10 and the passage hole 6 formed inside the grip 3. The air regulation pipe 8 is turned by the knob 11 provided outside the gun barrel 2 at the rear end thereof.

The air valve 9 is normally pressed against the sheet surface 13 of the spray gun main unit 1 by resilient force of a spring 12, thereby stopping the flow of compressed air. The needle valve 14, which extends toward the tip of the gun barrel 2 passes through the center of the air valve 9. At the rear end of the needle valve are provided a spring 15 and an opening adjusting knob 16 to control the backward movement of the needle valve 14.

In front of the air valve 9, an air valve rod 18 is provided about the needle valve 14, and acts to move the air valve 9 backward upon the operation of a trigger 17, thus sending compressed air into an air distribution chamber 19. If the trigger 17 is pulled further, the needle valve 14 retracts as the air valve rod 18 moves backward.

On the air distribution chamber 19, a distribution valve 20 is engaged by a rotatable knob 48 to provide for rotation of the valve 20. Two air passages are furnished toward the front part of the gun barrel 2. One of the passages is in permanent communication with the air distribution chamber 19 and is used to atomize the paint. The degree of communication of the other passage can be adjusted by adjusting the position of the notched recess 21 on the distribution chamber 19. Thus, it is used to control the flow rate and to adjust the spray pattern, as will be described later.

An atomizer is furnished at the tip of the gun barrel 2. A paint nozzle 22 for dispensing paint is mounted at the tip of the gun barrel 2. Flow of paint through the nozzle is stopped when the tip of the needle valve 14 seats against the surface 22a inside the nozzle hole 23 of the paint nozzle 22. The paint nozzle 22 is engaged with the spray gun main unit 1 such that a passage 24 is formed between the outside of nozzle 22 and the main unit 1. A primary air passage 27 extending from the distribution valve 20 communicates with the passage 24, and the passage 24 communicates with the passage 24'.

A paint passage 30 is formed at the center of the paint nozzle 22 and communicates with the paint supply source (not shown) through the paint nipple 51.

On the other hand, paint nozzle 22 forms the paint passage 30 at its center so that the tip of the needle valve contacts the surface 22a inside the nozzle hole 23, thus controlling the dispensing of paint. The paint nozzle 22 is covered with an air cap 40 which is fixed on the tip of the spray gun main unit 1 by a cover 41. The nozzle hole 23 is arranged inside and on the same axial line with a spray hole 32 which opens through the center of the air cap 40. The spray hole 32 forms a lip-like opening with the cylindrical inlet 33, providing a conical or approximately spherical inner surface 34 and a V-shaped groove 35 extending outwardly from its center. The front portion of the inlet 33 has a tapered surface 37 forming a primary air chamber 39, and is arranged in such a manner that the compressed air flows from the passage 24, through the passage 24' and between the tapered surface 37 and the tip 38 of the paint nozzle 22. The compressed air is mixed with the paint dispensed at the tip of the nozzle hole 23, is dispersed in a foggy state, and is sprayed from the spray hole 32. Because the spray hole 32 is formed as a V-shaped groove 35 with a lip-like opening as described above, the spray flow is blown out in an approximately elliptical shape.

It is known that, when the communicating area between the tapered surface 37 and the tip 38 of the paint nozzle 22 is increased, the size of the atomized particles is reduced. Thus, this communicating area is preferably at least equal to or larger than the opening of the V-shaped groove 35.

A conical outer surface 36 similar to the conical inner surface 37 is provided for the spray hole 32, and the wall thickness at the opening is made as thin as possible.

Figure 7:
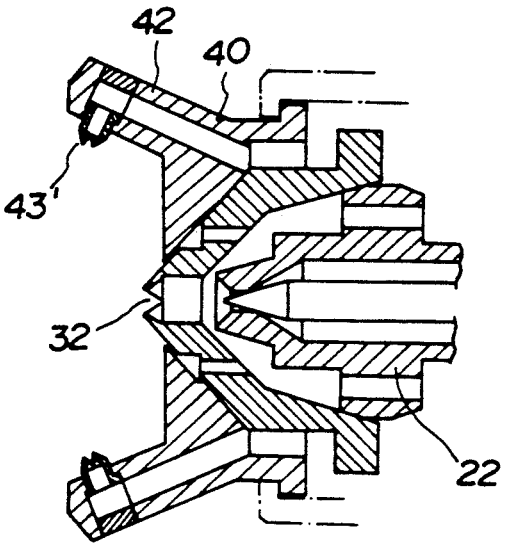
FIG. 7 is an enlarged cross-sectional view of an essential part of the atomizing head of the spray gun of FIG. 3, showing another embodiment of lateral air holes.

In the air cap 40, a passage 44 is formed in communication with a secondary air passage 29. At the corner 42, lateral air holes 43 are provided at opposite positions to flatten the air flow and direct the flow toward the center of spraying. In the embodiment, the lateral air hole 43 is shown as having the same opening shape as the spray hole 32. The flattened spray flow from the spray hole 32 is directed in the same direction as the flattened air flow supplied from the opening. Thus, almost all of the flattened air flow collides with the flattened spray flow dispensed from the spray hole 32. To dispense the flattened air flow, the lateral air hole 43 is provided with a lip-like opening by placing a V-shaped groove into a hole having conical or spherical inner surface, just as in the case of the spray hole 32. FIG. 7 shows an alternate example in which lateral air holes 43' are designed as separate structures and are incorporated separately.

Figure 8:
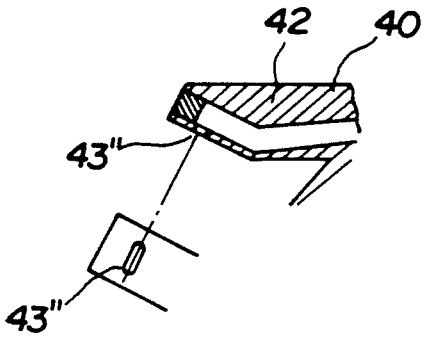
FIGS. 8(A) and (B) show another embodiment of lateral air holes for the spray gun of FIG. 1.
Figure 8:
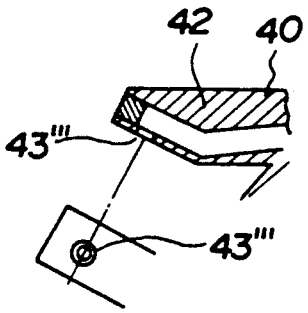

FIG. 8(A) shows another alternate example, in which the lateral air holes 43'' are designed with an elliptical shape, i.e. an oblong shape extending in a direction perpendicular to the spraying direction. FIG. 8(B) represents an example, in which the lateral air holes 43''' are designed with tapered fan-shaped circular holes. Particularly, in the case of the circular holes as in FIG. 8(B), wider spreading of the air flow can be achieved by maintaining the ratio of the opening area to the area of passage base at 1 or more, and extreme deformation of the spray pattern can be prevented.

Figure 3:
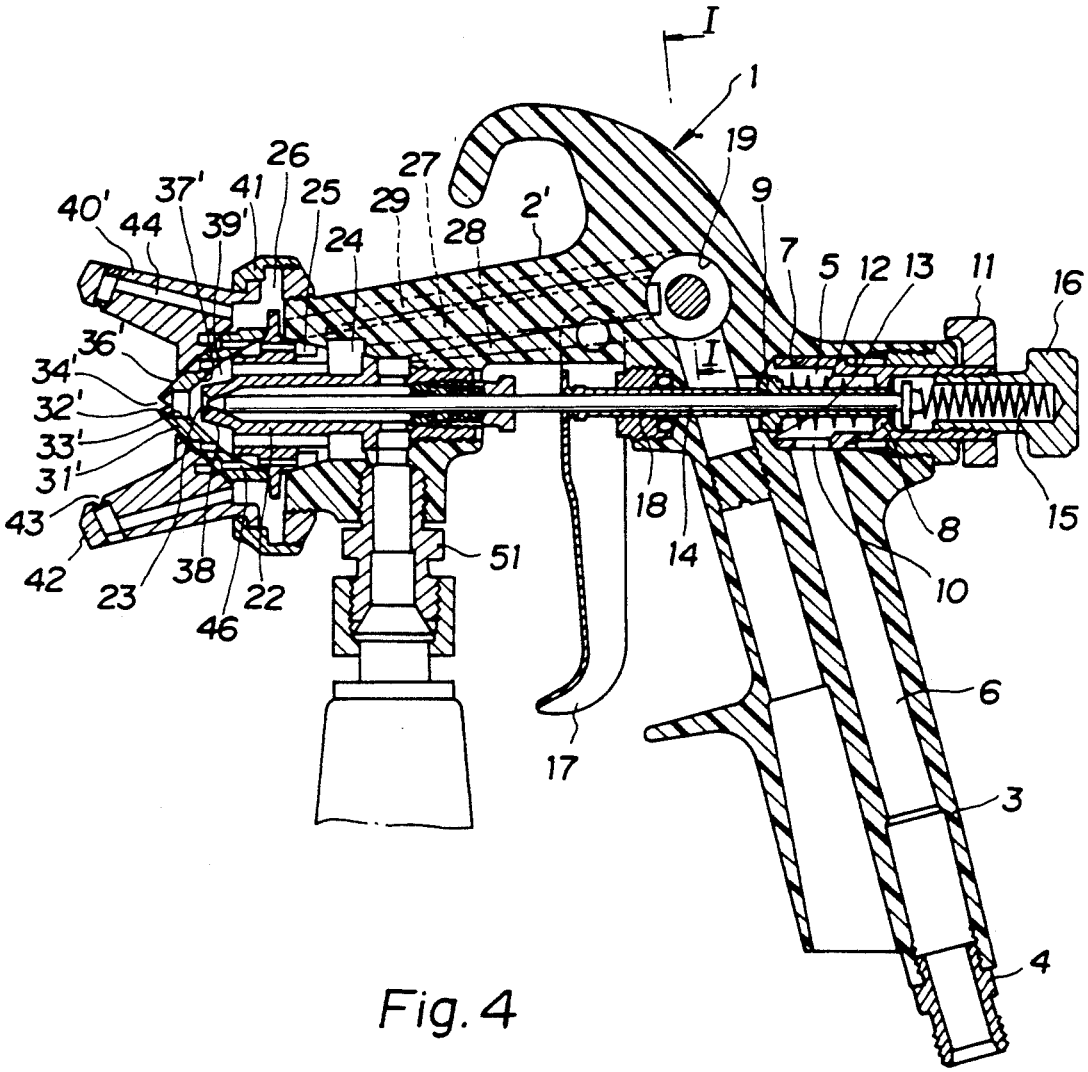
FIG. 3 is a cross-sectional view of another embodiment of this invention.
Figure 4:
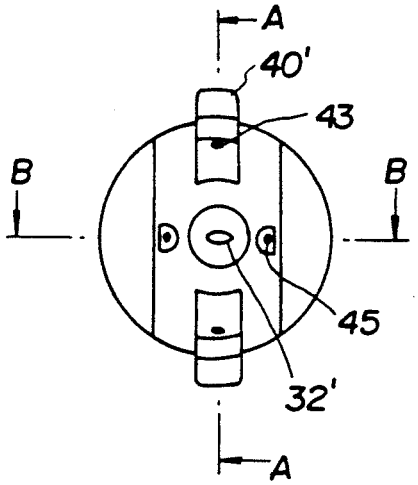
FIG. 4 is a front view of an atomizing head of the spray gun of FIG. 3.
Figure 5:
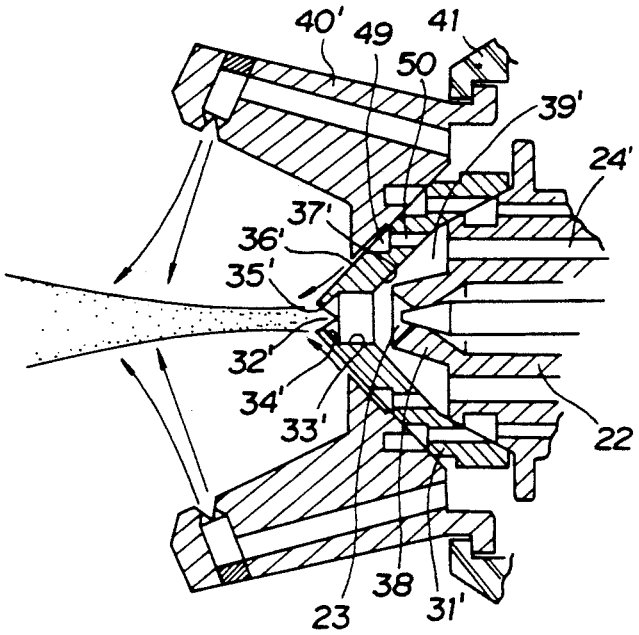
FIG. 5 is an enlarged cross-sectional view of an essential part of the atomizing head of the spray gun of FIG. 3, taken along the line A—A of FIG. 4, showing the spray flow and the injection flow from lateral air holes.

FIG. 3 shows a spray gun according to another embodiment of this invention, in which like reference numerals refer to like components in the above embodiment.

The paint nozzle 22 is covered with the tip cap 31', and the nozzle hole 23 is provided on the same axial line as a spray hole 32', which opens toward the tip center of the tip cap 31'. As in the embodiment already described, the spray hole 32' comprises a cylindrical inlet 33' with a conical or approximately spherical inner surface 34'. A V-shaped groove 35' is formed at the center, and an approximately lip-like opening is provided.

The frontal portion of the inlet 33' has a tapered surface 37', and the primary air chamber 39' is formed. It is arranged in such manner that the compressed air from air passage 24 and the passage 24' flows between the tapered surface 37' and the tip outer diameter 38 of the paint nozzle 22.

Conical outer surface 36' is provided outside the spray hole 32' and corresponds to the conical inner surface 37'. An air cap 40' which is engaged with the conical outer surface 36' and has air injection holes at symmetrical positions about the spraying axis, is furnished and cooperates with the tip cap 31. It is removably fixed on the tip of the spray gun main unit 1 by a cover 41.

Figure 9:
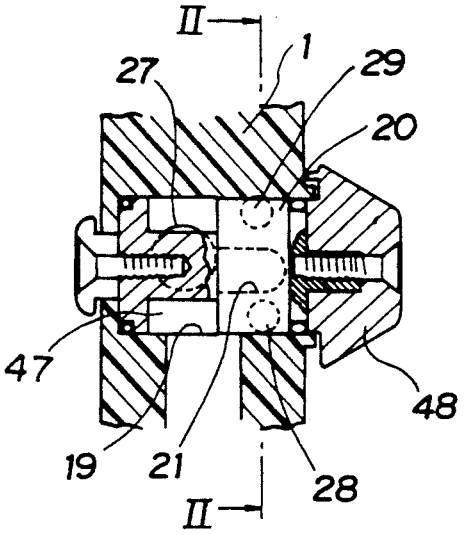
FIG. 9 is an enlarged cross-sectional view taken along the line I—I of FIG. 3, showing an essential part of an air distribution valve.
Figure 10:
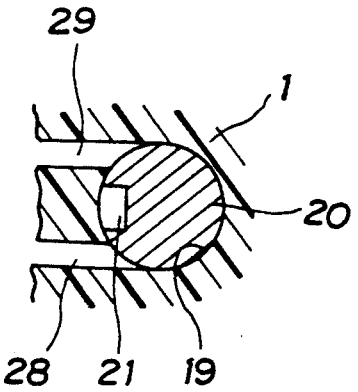
FIG. 10 is a cross-sectional view taken along the line II—II of FIG. 9, showing the positional relation between the air distribution valve and a secondary air passage.
Figure 11:
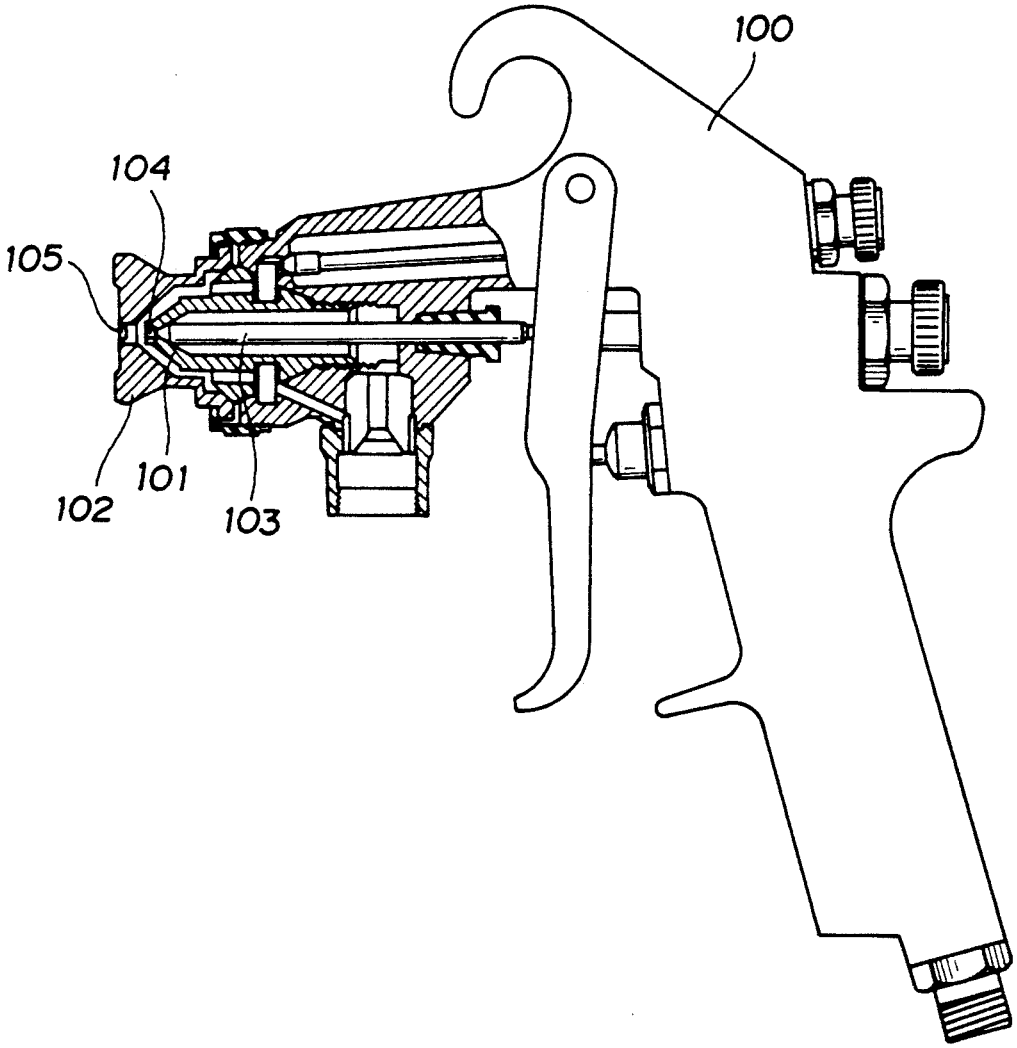
Fig. 11 PRIOR ART
FIG. 11 shows a cross-section of an essential part, including the atomizing head, of a conventional internal mixing type spray gun.

In this embodiment, three air passages are provided in the gun barrel 2' from the air distribution chamber 19 to the frontal portion of the gun barrel 2'. One of the passages opens, as the primary air passage 27, into a smaller diameter portion 47 (see FIG. 9) of the distribution valve 20, is permanently communicated with the air distribution chamber 19 and is used to supply compressed air, which is mixed with the paint injected from the nozzle hole 23 and sprayed from the spray hole 32'. The communicating area of the other two air passages 28, 29 is dependent upon the rotational position of the notched recess 21 on the distribution valve 20, and flow rate is thus adjustable. As shown in FIG. 9, the air distribution valve 20 is engaged in the air distribution chamber 19 in such manner that it can be freely rotated by the externally mounted knob 48. Therefore, it is possible to control the distribution quantity and ratio by changing the communicating area by rotating the distribution valve 20. The two air passages 28, 29 are used as the secondary air passages. One air passage 28 is in communication with the passage 25, and the other air passage 29 is in communication with the passage 44 provided inside the air cap 40'.

On the atomizer at the tip of the gun barrel 2', a pair of second air dispensing holes or longitudinal air outlets 45 are furnished along a line through the central axis of the spray hole 32', the line being orthogonal to a line through the central axis of spray hole 32' and the lateral air holes 43 of the air cap 40'. Thus, compressed air is dispensed obliquely toward the front.

Figure 6A:
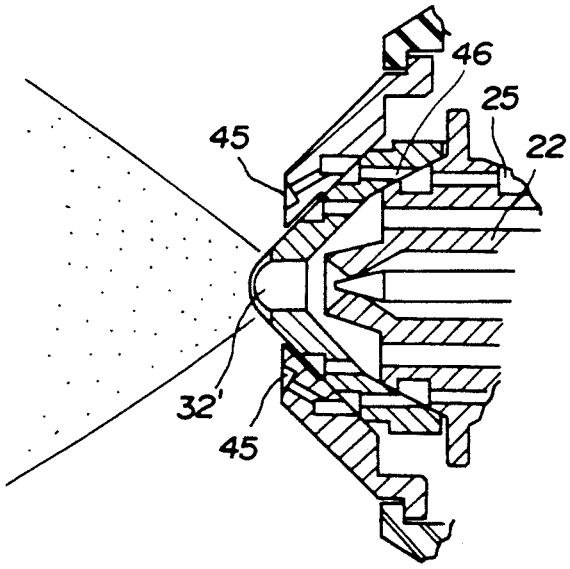
FIG. 6(A) is an enlarged cross-sectional view of an essential part of the atomizing head of the spray gun of FIG. 3, taken along the line B—B of FIG. 4, showing the spreading of the spray pattern when the air is not injected from the second injection hole.
Figure 6B:
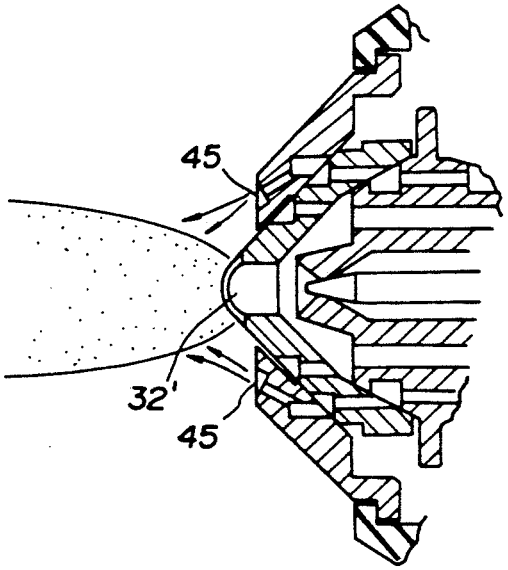
FIG. 6(B) is an enlarged cross-sectional view of an essential part of the atomizing head of the spray gun of FIG. 3, taken along the line B—B of FIG. 4, showing how the spray pattern is reduced by the injection of the air from the second injection hole.

As shown in FIGS. 6(A) and (B), air is guided toward the spray flow from the spray hole 32' in order to reduce the spray pattern along the major axis thereof. The pair of second dispensing holes 45 are in communication with the air passage 25, provided outside the paint nozzle 22, through the passage 46 on the tip cap 31'.

Therefore, of the two secondary passages 28 and 29 from the air distribution valve 20, one passage dispenses through the second dispensing holes 45, and the other through lateral air holes 43. Thus, the secondary air is in communication with either one of these passages by way of the distribution valve 20. If the air is supplied to the lateral air holes 43, a larger spray pattern results, and if it is supplied to the second dispensing holes 45, a nearly circular and smaller spray pattern results.

In the drawings, 49 represents an auxiliary air hole provided in the tip cap 31' and in communication with the primary air chamber 39'.

As described above, it is possible according to this invention to dispense the air at low pressure from the air cap, to mix and disperse the paint by utilizing lower pressure compressed air, to inject the spray flow from a lip-like opening furnished at the center of the air cap and to spray it in a flattened pattern. By blowing air flow toward the spray flow along the direction of the shorter axis of the paint spray pattern, the pattern can be stabilized and the pattern width can be adjusted. Because each air flow works effectively, the same atomizing performance can be achieved with far lower air pressure than the conventional type, and it is possible to prevent the splashing of paint particles and to avoid the environmental pollution because spraying is performed at lower pressures.

Further, it is possible by this invention to mix and atomize the paint with compressed air within the spray hole. With the present invention, an atomized spray pattern suitable for painting oan be obtained at pressures as low as 1/5 of oonventional air spray guns because oompressed air flow is collided with the spray flow by re-atomizing and by forming and adjusting the pattern. Since no hydraulic atomizing means is employed, paint may be fed by use of low pressure air as described above, and no special pressurizing means for the paint is required. Accordingly, the new spray gun can be used as easily as the conventional type air spray gun, but better results can be obtained.

It is generally difficult to adjust the size and width of the spray pattern for conventional spray guns where particles are atomized in a flattened spray pattern determined by the shape of the spray hole. However, according to this invention, it is possible to adjust the spray pattern by, for example, blowing air from the lateral air holes to enlarge the pattern, and blowing air from the second dispensing holes to result in a nearly circular and smaller spray pattern. Thus, the pattern width can be significantly adjusted and a suitable spray pattern can be easily selected.

In addition to supplying air through the primary air passages, two independent secondary air passages are provided for pattern formation or for pattern adjustment. Moreover, the air must be permanently supplied through the primary air passage, and air flow must be adjustable through one of the secondary air passages. From the air distribution valve of this invention, a plurality of passages can be provided, some of which are in permanent communication with the air nipple through the small diameter portion, and some of which are in adjustable communication with the air nipple through the notched recess which is adjustable by rotating the valve to change its position with respect to the inner surface of the air distribution chamber. It is also possible to supply compressed air to each passage by operating a single distribution valve.

We claim:

1. An apparatus for a spray gun, comprising:

a nozzle adapted to be mounted to a forward end of a spray gun and having a circular nozzle opening adapted to have paint flow therethrough;

a tip cap mounted to and about said nozzle and having a concially shaped inner surface, a conically shaped outer surface, and a spray hole formed therein, said spray hole being formed about a forwardly and rearwardly extending spray axis through a front end of said tip cap and being defined by an oblong V-shaped groove with a major axis and a minor axis which are perpendicular to said spray axis;

first air flow means for providing a first substantially forwardly directed flow of compressed air about said nozzle and toward said tip cap, such that when paint is fed fowardly through said nozzle opening, the paint is mixed with and atomized by the first flow of compressed air and then ejected through said spray hole of said tip cap in a spray pattern;

an air cap mounted to said tip cap and comprising second air flow means for providing a second flow of compressed air to further atomize the paint after it has been ejected through said spray hole of said tip cap and to control the pattern of paint spray at locations downstream of said spray hole, said second air flow means comprising two lateral air outlets arranged forwardly of and symmetrically about said spray hole on sides thereof adjacent opposing ends of said minor axis of said oblong V-shaped groove defining said spray hole;

wherein said air cap further comprises a pair of longitudinal air outlets arranged rearwardly of and symmetrically about said spray hole on sides thereof adjacent opposing ends of said major axis of said oblong V-shaped groove defining said spray hole;

wherein a distribution control means is provided for controlling the raito of the rate of air flow through said lateral air outlets to the rate of air flow through said longitudinal air outlets; and wherein said distribution control means comprises a distributing valve having a pair of adjustable distribution openings and is operable such that adjustment to increase an opening amount of one of said distribution openings causes a corresponding decrease in an opening amount of the other of said distribution openings, and such that adjustment to increase the opening amount of said other of said distribution openings causes a corresponding decrease in the opening amount of said one of said distribution openings.

2. An apparatus as recited in claim 1 wherein said oblong V-shaped groove defining said spray hole comprises an ellipticla V-shaped groove.

3. An apparatus as recited in claim 1, further comprising paint control means for controlling the rate of flow of paint through said nozzle opening of said nozzle.

4. An apparatus as recited in claim 3, wherein said paint control means comprises a needle valve.

5. An apparatus for a spray gun, comprising:

a nozzle adapted to be mounted to a forward end of a spray gun and having a nozzle opening adapted to have paint flow therethrough;

a tip cap, having a spary hole formed through a front end thereof, mounted to and about said nozzle;

first air flow means for providing a first substantially forwardly directed flow of compressed air about said nozzle and toward said tip cap, such that when paint is fed forwardly through said nozzle opening, the paint is mixed with and atomized by the first flow of compressed air and then ejected through said spray hole of said tip cap in a spray pattern;

an air cap mounted to said tip cap and comprising second air flow means for providing a second flow of compressed air to control paint atomization and the spray pattern;

wherein said nozzle oepning has a conical inner profile diverging forwardly and opening through an outer surface thereof toward said spray hole;

wherein said tip cap has an inlet area formed adjacent a front end thereof opposing a forward end of said nozzle opening and having an inside diameter which is less than or equal to the forwardmost end of said conical inner profile of said nozzle opening; and wherein a forward end of said tip cap has a concial inner profile with an inner diameter thereof converging forwardly from said inlet area, and a conical outer profile with an outer diameter thereof converging forwardly, so as to form a reduced wall thickness portion at said front end of said tip cap, an oblong V-shaped groove being formed through said reduced wall thickness portion to define said spray hole.

6. An apparatus as recited in claim 5, wherein said oblong V-shaped groove defining said spray hole comprises an elliptical V-shaped groove.

* * * * *